US005742273A

United States Patent [19]

Flinders et al.

[11] Patent Number: 5,742,273

[45] Date of Patent: Apr. 21, 1998

[54] VIDEO MONITOR/ADAPTER INTERCONNECT EXTENSION ARCHITECTURE

[75] Inventors: Michael Flinders; Adrian John Hawes, both of Chandlers Ford, England; Cynthia Kocialski; Marco Michael Rengan, both of Boca Raton, Fla.

[73] Assignee: International Business Machines Corp., Armonk, N.Y.

[21] Appl. No.: 17,794

[22] Filed: Feb. 16, 1996

[51] Int. Cl.[6] ..... G09G 5/00

[52] U.S. Cl. ..... 345/132; 395/112; 395/500; 345/204

[58] Field of Search ..... 395/275, 500, 395/112, 550, 200.14, 200.1; 375/8; 345/132, 204; 364/927.7, 231.4

[56] References Cited

U.S. PATENT DOCUMENTS

| | | | |
|---|---|---|---|
| 3,805,251 | 4/1974 | Morris et al. | 340/172.5 |
| 3,953,835 | 4/1976 | Cuccio et al. | 340/172.5 |
| 4,342,029 | 7/1982 | Hofmanis | 345/22 |
| 4,876,533 | 10/1989 | Barkans | 345/118 |
| 4,882,687 | 11/1989 | Gordon | 395/135 |
| 5,113,497 | 5/1992 | Dewa | 395/275 |
| 5,159,683 | 10/1992 | Lvovsky | 395/500 |
| 5,257,350 | 10/1993 | Howard et al. | 345/132 |
| 5,276,458 | 1/1994 | Sawdon | 395/162 |

FOREIGN PATENT DOCUMENTS

| | | | |
|---|---|---|---|
| 0 456 923 A1 | 11/1991 | European Pat. Off. . | |
| 463269 | 1/1992 | European Pat. Off. | 375/8 |
| 40 25 295 A1 | 2/1991 | Germany . | |

OTHER PUBLICATIONS

Self-Identification Protocol Initialization, IBM Technical Disclosure Bulletin, vol. 33, No. 10A, Mar. 1991.

Control Method for Constitution of Network, Patent Abstracts of Japan, vol. 11, No. 83, (E-489), Mar. 13, 1987.

Tandy, "TRS-80 Color Computer Technical Reference Manual" Ft Worth. 1981 pp. 18-19.

IBM Technical Disclosure Bulletin vol. 33, No. 6B, Nov. 1990 "Improvements to Display Identification".

IBM Technical Disclosure Bulletin vol. 33, No. 6A, Nov. 1990 "Monitor Identification Range Extension".

*Primary Examiner*—Richard Hjerpe
*Assistant Examiner*—Lun-Yi Lao
*Attorney, Agent, or Firm*—Calfee, Halter & Griswold LLP; Sean T. Moorhead, Esq.; Martin McKinnely, Esq.

[57] ABSTRACT

A video subsystem for a computer system comprising a video adapter and a video monitor electrically communicating over a display cable having at least two monitor identification lines. The three system components are designed such that after the video adapter reads the monitor identification from the monitor identification lines, the adapter and monitor reuse the monitor identification lines as a bidirectional serial link, over which large amounts and types of data may be transferred.

16 Claims, 3 Drawing Sheets

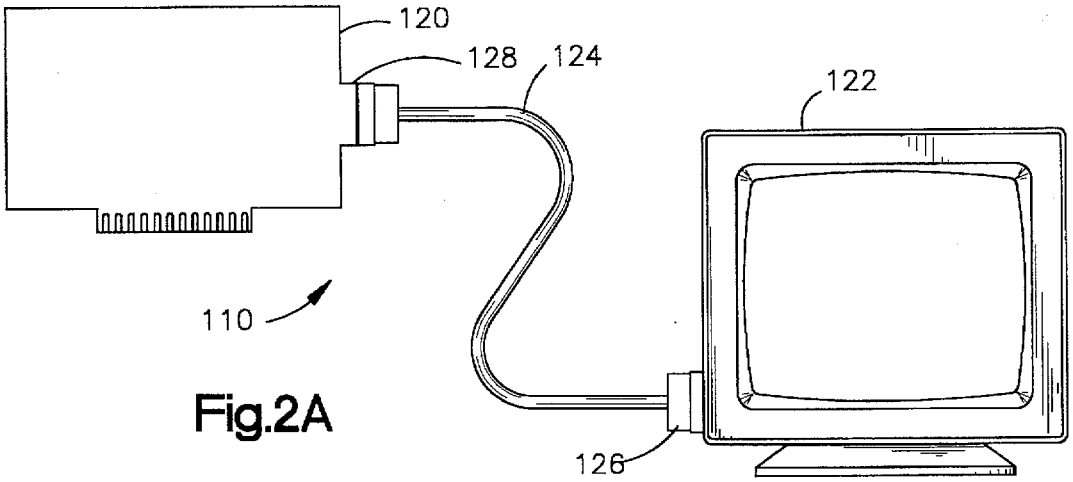
Fig.2A
Fig.3A
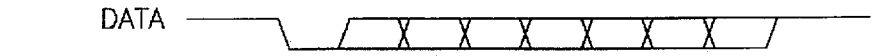
Fig.3B
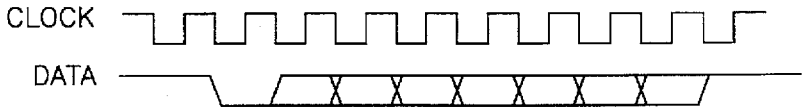
Fig.3C
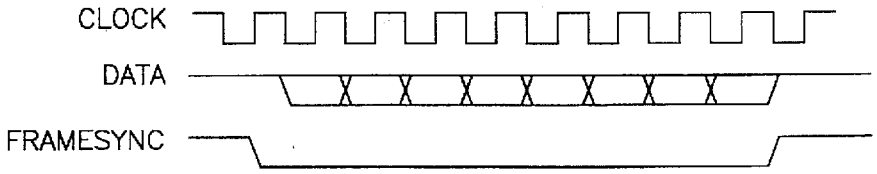
Fig.3D
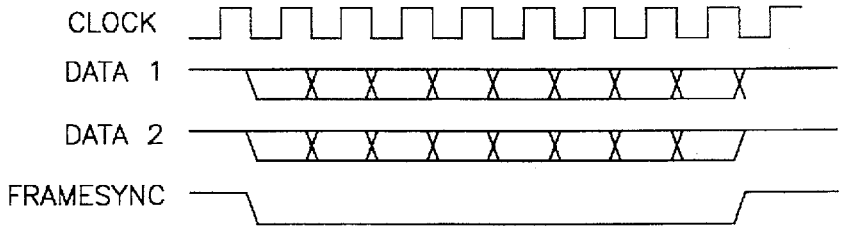
Fig.3E
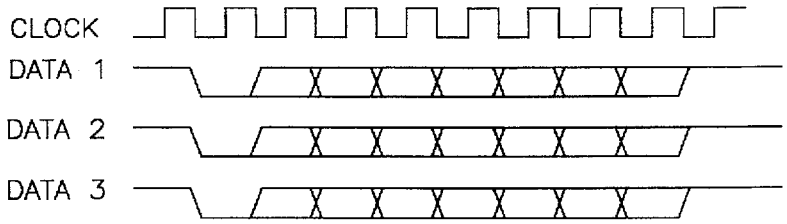

VIDEO MONITOR/ADAPTER INTERCONNECT EXTENSION ARCHITECTURE

FIELD OF THE INVENTION

The present invention relates generally to computer system architecture and, more specifically, to a video subsystem having a video display adaptor, a monitor cable, and a video display monitor designed so that the monitor identification pins are reused to provide a bidirectional serial link between the adaptor and the monitor.

BACKGROUND OF THE INVENTION

Personal computer systems are well known in the art. Personal computer systems in general, and IBM Personal Computers in particular, have attained wide-spread use for providing computer power to many segments of today's modern society. Personal computers can typically be defined as a desktop, floor standing, or portable microcomputer that is comprised of a system unit having a single central processing unit (CPU) and associated volatile and non-volatile memory, including all RAM and BIOS ROM, a system monitor, a keyboard, one or more flexible diskette drives, a fixed disk storage, and an optional printer. One of the distinguishing characteristics of these systems is the use of a motherboard or system planar to electrically connect these components together. These systems are designed primarily to give independent computing power to a single user and are inexpensively priced for purchase by individuals or small businesses. Examples of such personal computer systems are IBM's PERSONAL COMPUTER AT and IBM's PERSONAL SYSTEM/2.

Personal computer systems are typically used to run software to perform such diverse activities as word processing, manipulation of data via spread-sheets, collection and relation of data in databases, displays of graphics, design of electrical or mechanical systems using system-design software, etc.

Personal computer systems typically have a video subsystem comprising a video display adapter, a video display monitor, and a monitor cable. The video display adapter, also known as a "microcomputer display adapter" and herein as an "adapter" or a "video adapter," generates the electrical signals corresponding to the visual image displayed by the video display monitor, also known as a "visual display unit" and herein as a "monitor" or "video monitor." The adapter may be either an integral part of the system planar or may be an adapter card electrically connected to the system planar via an expansion slot.

The monitor cable connecting the monitor to the adapter typically has 15 pins. The 15 pins at the connector mating with the video adapter typically include: red, green, and blue analog video pins, each having an associated ground pin, the horizontal synchronization (HSYNC) and vertical synchronization (VSYNC) timing signal pins, four monitor identification (MID) signal pins, a plug ground pin, a self-test pin, and a sync ground pin.

The MID signals are directed toward the adapter and are typically used to convey one piece of static information about the monitor—the type of monitor—to the adapter. The HSYNC and VSYNC signals are generated by the video adapter and directed to the monitor and are used to control the horizontal and vertical blanking within the monitor, respectively. The three video signals are generated by the adapter and directed to the monitor and are analog electrical signals corresponding to the visual image displayed by the monitor.

Typical monitor cables provide 4 binary bits of static MID data to the adapter. Four binary bits provide 16 possible MID codes. The MID code for a given monitor is fixed. For example, a monitor with a MID code of $1010_2$ will always have that code. Because the code is fixed, manufacturers hardwire the code into the monitor cable. Thus, typical monitor cables provide only one small piece of information in only one direction—toward the adapter.

In the past, the 16 possible MID codes were sufficient to cover the spectrum of monitors. However, there is currently a need to transfer more than one code to the adapter and a need to move beyond the limit of sixteen possible codes. For example, there are numerous monitors available in the market and, therefore, there is currently a need to expand beyond the 16 possible MID codes that the current MID scheme provides. Additionally, there is a need for the adapter to be able to detect the power-on or power-off status of the monitor. Also, there is a need for an enhanced mode signalling capability from the adapter to the monitor, whereby the adapter will communicate the desired display parameters (e.g. resolution, frequency, etc.) to the monitor. In addition, there is a need for the monitor to transmit vital product data and monitor characteristics data to the adapter. In short, there is currently a need to transmit many pieces of data either from the monitor to the adapter and vice versa. Current components cannot meet this need because, currently, monitors only supply one piece of permanent information to the adapter and adapters have no way of communicating to the monitors.

One obvious way of increasing the amount of data able to be transferred between the monitor and the adapter is to add the necessary pins and electrical connections to the monitor cable. However, adding pins to the monitor cable would increase the cost of any monitor or adapter. Moreover, the 15-pin connector used in typical personal computer video subsystems has become a widely accepted standard and it is desirable to achieve backward compatibility with existing systems. That is, (1) any new video adapter must function with existing monitors at least as well as the older adapters and (2) any new monitor must function with existing video adapters at least as well as the older monitors. Therefore, any solution to the problem that requires the addition of pins to the monitor cable is unsatisfactory.

It is therefore an object of the present invention to provide a method of expanding the number of possible MIDs able to be conveyed from a monitor to an adapter without adding additional pins to the monitor cable.

It is a further object of the present invention to provide a method of communicating large amounts of information between a video adapter and a video monitor without adding additional pins to the monitor cable.

SUMMARY OF THE INVENTION

According to the present invention, the adapter, the monitor, and the monitor cable are modified in such a manner that the monitor identification pins are able to be reused to provide an electrical pathway for a bidirectional serial link between the adapter and the monitor. This redesigned video subsystem is termed the "Monitor/Adapter Interconnect Extension" ("MIX").

The MIX adapter is modified to read the MID code from the MID lines as well as communicate bidirectionally over the MID lines.

The MIX monitor cable, herein the "display cable," is modified so it no longer has the MID code hardwired inside it and, thus, the display cable need no longer be an integral part of the monitor. The display cable merely provides 15 electrical signal paths between the MIX adapter and the MIX monitor.

The MIX monitor is modified so it no longer relies on the monitor cable to generate the MID code. The MIX monitor is designed to generate the MID code itself. Furthermore, the MIX monitor is designed with means to communicate bidirectionally with the adapter over the MID lines.

On power-up, both the MIX monitor and the MIX adapter presume that they are not connected to a MIX-capable counterpart. The MIX monitor presents a fixed MID code along the MID lines. The MIX adapter reads any MID code from the MID lines.

It is at this point that the two determine whether they are connected to MIX-capable counterparts by handshaking. The adapter starts the handshake by signaling to the monitor by setting both the HSYNC and VSYNC to a known state, then toggling one or both of them from one state to the other for a fixed number of toggles at a predetermined rate. A non-MIX monitor will ignore the signals. A MIX monitor will recognize that it is connected to a MIX adapter and will respond by presenting a special code on the MID lines. This special code allows the MIX adapter to recognize that a MIX monitor is powered up and has received the handshake signal. The monitor then stops asserting the MID code on the MID lines and the MIX adapter and MIX monitor are free to communicate bidirectionally along the MID lines.

It is therefore an object of the present invention to provide a video subsystem in which the adapter, the monitor, and the monitor cable are modified so that the MID lines are reused as a bidirectional communication link.

It is a further object of this invention to provide the above MID reuse while maintaining backward compatibility with existing components.

These and other objects and advantages of the present invention shall become more apparent from a detailed description of the invention.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below serve to example the principles of this invention.

FIG. 2A is a schematic view of a video subsystem of the present invention.

FIGS. 3A through 3E are timing diagrams showing various alternative communication configurations for communicating over the reused MID lines.

DETAILED DESCRIPTION OF THE PREFERRED EMBODIMENT

Figure 1A:
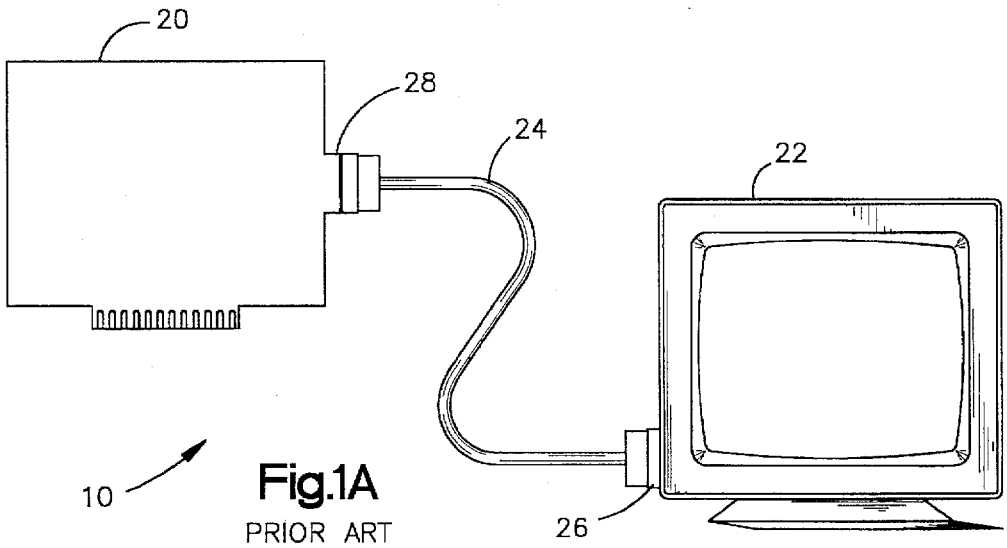
Fig.1A PRIOR ART
FIG. 1A is a schematic view of a prior art video subsystem.
Figure 1B:
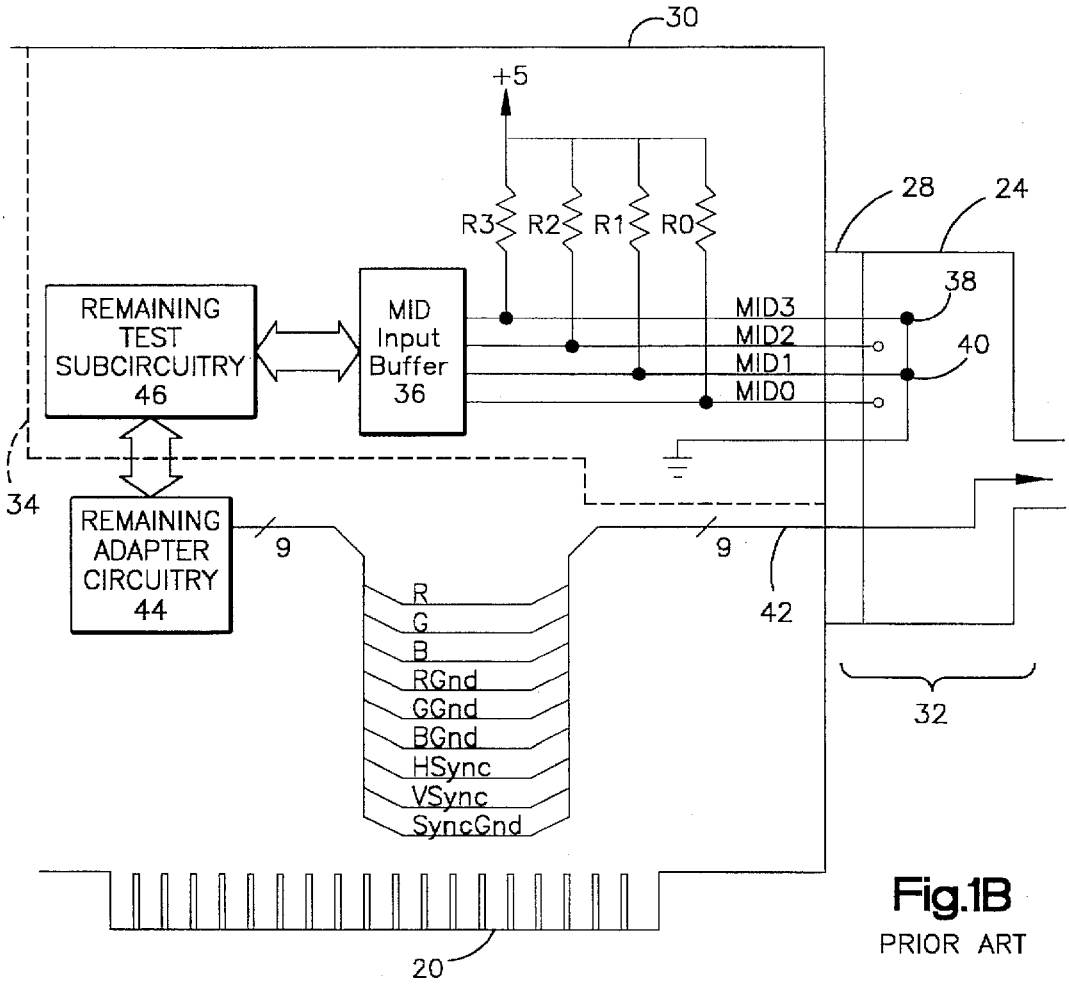
Fig.1B PRIOR ART
FIG. 1B is an electrical schematic of a prior art video subsystem showing the monitor identification subcircuit.

Before describing the details of the present invention, a description of a typical possible prior art video subsystem may be helpful in understanding the advantages of the video subsystem of the present invention. Reference is had, therefore, to FIGS. 1A and 1B, which show a prior art video subsystem 10. A typical prior art video subsystem 10 has a video adapter 20 connected to a video monitor 22. The monitor 22 has associated with it an integral monitor cable 24 attached to the monitor 22 at an attachment point 26. The monitor cable 24 connects to the video adapter 20 at a display connector 28 and allows electrical communication between the video adapter 20 and the video monitor 22.

Prior art video adapters 20 are well known in the art. They typically include a ROM BIOS, a test subcircuit, a video memory, a digital to analog converter, a cathode ray tube (CRT) controller, a sequencer, a graphics controller, and an attribute controller. Prior art monitors 22 are also well known in the art. They typically include a power supply, a CRT subcircuit, and an input subcircuit.

The display connector 28 is typically a 15-pin connector and typically brings 14 signal lines out from the video adapter 20: three video signal lines (red, green, and blue), each with an associated ground line, four monitor identification (MID) signal lines; a horizontal synchronization timing signal (HSYNC) line; a vertical synchronization timing signal (VSYNC) line; a sync ground line; a self-test signal line; and a plug ground line. The three video signals are analog signals ranging from 0.0 to 0.7 VDC. The HSYNC, and VSYNC signals are typically TTL or "Fast" TTL signals with typical TTL or "Fast" TTL logic levels, which are well known in the art. The MID lines are typically pulled up to a high logic state with pull-up resistors of an appropriate value within the adapter 20.

FIG. 1B is a schematic diagram showing an example of a prior art monitor ID subcircuit 30, which is a combination of the hardwired MID subcircuit 32 within the monitor cable 24 and the test subcircuit 34 of the adapter 20. The four MID lines MID0–MID3 provide a four-bit nibble of binary data that can be read by monitor ID input buffer 36 of the test subcircuit 34 of the adapter 20. The monitor ID lines MID0–MID3 are pulled up to a logic 1 by associated pull-up resistors R0–R3, which are part of the test subcircuit 34 of the video adapter 20. Recall that the MID lines are either logic 1 or logic 0. Because the MID lines MID0–MID3 are pulled up to logic 1 by the associated pull-up resistors R0–R3, a desired MID code bit may easily be hardwired within the monitor cable 24 by either tying the desired MID line to the ground line (if a MID code bit of logic level 0 is desired) or not tying the desired MID line to the ground line (if a MID code bit of logic level 1 is desired) within the monitor cable 24.

In FIG. 1B, the MID1 and MID3 lines are tied to ground at 38 and 40, respectively, therefore, they are at logic level 0 when the monitor cable 24 is plugged into the display connector 34, as shown in FIG. 1B. Conversely, the MID0 and MID2 lines are not tied to ground, therefore, they remain at logic level 1. The MID code is then readable by the MID input buffer 36 of the adapter 20.

The monitor cable 24 typically comprises at least nine conductors 42 that electrically connect the adapter 20, to the monitor 22. Five conductors transmit the three video data signals, HSYNC, and VSYNC from the adapter 20, which generates these signals, to the monitor 22, which receives these signals. The four remaining conductors provide ground paths and include the three video ground lines and the sync ground line. As shown in FIG. 1B, the four MID lines MID0–MID3 do not reach the monitor 22. However, the MID lines MID0–MID3 can be extended into the monitor 22, where they are hardwired to reflect a particular MID code. The critical feature of the prior art MID subcircuit 30 is that the MID code is hardwired.

Using the prior art video subsystem 10 is very simple. The user merely plugs the monitor cable 24 into the display connector 28 of the video adapter 20. Either the video adapter 20 or the monitor 22 may be turned on first. Neither is aware of the other's power status.

When the adapter 20 is powered on, the MID input buffer 36 of the test subcircuit 34 reads the MID code from the MID lines MID0–MID3 and transmits it to remaining adapter circuitry 44 via remaining test subcircuitry 46, thereby making this code available for use by the adapter 20 and the software running on the computer system. Then remaining adapter circuitry 44 of the adapter 20 starts transmitting the three video data signals (R, G, and B), the VSYNC signal, and the HSYNC signal. As previously mentioned, the three video ground lines and the sync ground lines do not have associated directed signals per se, but merely provide electrical ground paths.

Some newer monitor cables 24 have MID codes based on four bits of four possible states: 0, 1, H, or V. That is, instead of being limited to either tying a MID line to ground or not (resulting in either logic 0 or logic 1, respectively), some monitor cables either do not tie a MID line to anything (resulting in logic 1), or tie the MID to either ground, HSYNC, or VSYNC. Thus, a resulting MID code may be, for example, $1H1V_s$ or $00HV_s$ ("s" meaning "special"). In systems with this type of MID, four reads are needed to adequately determine the MID code.

In the first read, HSYNC and VSYNC are placed into a logic 1 state by the remaining adapter circuitry 44 and the MID code is read by the MID input buffer 36. Any of the MID lines MID0–MID3 at logic 0 during that read are deemed tied to ground and at special level "0."

In the second read, HSYNC is placed into a logic 0 state and VSYNC is placed into a logic 1 state by the remaining adapter circuitry 44 and the MID code is read by the MID input buffer 36. Any of the MID lines MID0–MID3 at logic 0 during that read, that were not at logic 0 before, are deemed tied to HSYNC and at special level "H."

In the third read, HSYNC is placed into a logic 1 state and VSYNC is placed into a logic 0 state by the remaining adapter circuitry 44 and the MID code is read by the MID input buffer 36. Any of the MID lines MID0–MID3 at logic 0 during that read, that were not at logic 0 during the two earlier reads, are deemed tied to VSYNC and at special level "V."

In the final read, HSYNC is placed into a logic 0 state and VSYNC is placed into a logic 0 state by the remaining adapter circuitry 44 and the MID code is read by the MID input buffer 36. Any of the MID lines MID0–MID3 NOT at logic 0 during that read, are deemed not tied to either ground, HSYNC, or VSYNC and are at special level "1." Thus, these four reads allow the system to determine the true MID code.

If the monitor 22 is powered on before the adapter 20 is powered on, the monitor 22 will have nothing to display until the adapter 20 is powered on. Once the adapter 20 is powered on and begins transmitting the five directed signals (R, G, B, HSYNC, and VSYNC) the monitor 22 will display a visual image corresponding to the five directed signals.

Thus, in the prior art video subsystem 10, neither the adapter 20 nor the monitor 22 know the other's power status. Additionally, because there are only four MID lines MID0–MID3, the adapter 20 may only discern 16 (24) possible hardwired MID codes from the monitor cable 24. Note that in the MID subcircuit 30 of FIG. 1B, the video adapter 20 can read the MID code of the monitor cable 24 while the monitor 22 is turned off, because the MID subcircuit 30 does not depend on any signal generated by the monitor 22.

Under the present invention, the prior art video adapter 20, the prior art video monitor 22, and the prior art monitor cable 24 of the prior art video subsystem 10 are modified so that the MID lines MID0–MID3 can be reused to provide a communication link between the adapter and the monitor.

Figure 2B:
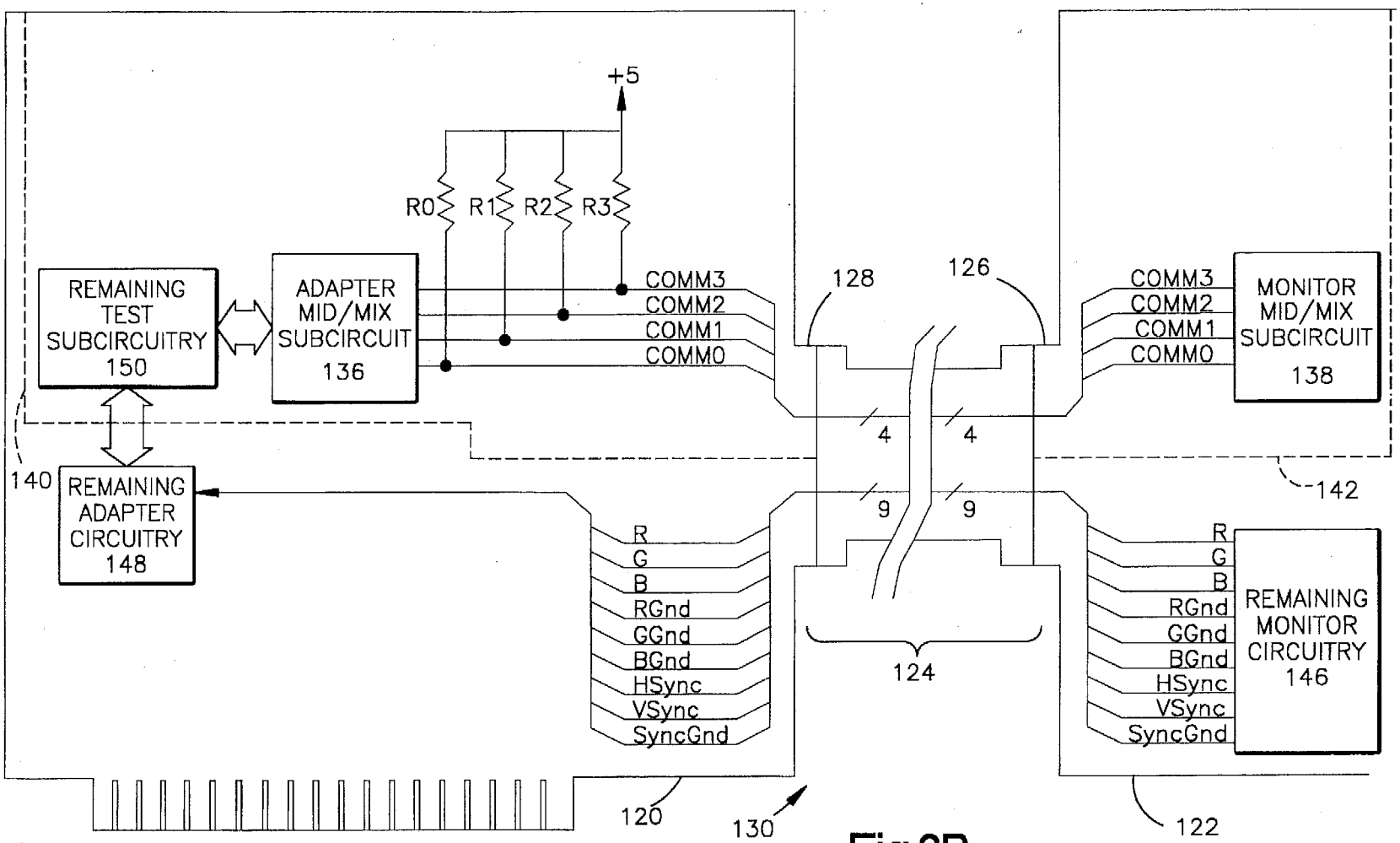
FIG. 2B is an electrical schematic of a video subsystem of the present invention showing the MID/MIX subcircuit.

FIGS. 2A and 2B show a video subcircuit 110 of the present invention. As shown in FIG. 2A the video subcircuit 110 comprises a video adapter 120 electrically connected to a video monitor 122 by a display cable 124. The display cable 124 may be, but is not required to be, an integral part of either the video adapter 120, or the video monitor 122, or both the adapter 120 and the monitor 122, or may be an integral part of neither the adapter 120 nor the monitor 122. In the best mode, the display cable 124 is an integral part of neither the adapter 120 or the monitor 122. In this best mode, the display cable 124 connects to the monitor 122 at a monitor connector 126 and connects to the adapter 120 at a display connector 128.

The nature of the five signals directed toward the monitor 122 remain the same. R, G, and B are analog signals ranging from 0.0 to 0.7 VDC. HSYNC and VSYNC are TTL signals. The four ground lines (three video ground lines and the sync ground line) remain the same and merely provide ground paths. In the best mode, the MID signals become $I^2C$ (inter-integrated circuit) signals. The $I^2C$ bus is an open collector serial bus offered by Signetics Corp., a subsidiary of Philips N. V.

FIG. 2B shows a MID/MIX subcircuit 130 comprising the display cable 124 and portions 140 and 142 of the adapter 120 and the monitor 122, respectively. In the adapter 120, the MID input buffer 36 of the prior art adapter 20 is replaced by an adapter MID/MIX subcircuit 136. The hardwired MID subcircuit 32 within the prior art monitor cable 24 is replaced with four conductors COMM0–COMM3. These communications lines COMM0–COMM3, previously the MID lines MID0–MID3 and associated with the same pins of the 15-pin connector, will carry the MID code from the monitor 122 to the adapter 120 and will subsequently provide a communications path between the adapter 120 and the monitor 122. The communication lines COMM0–COMM3 are pulled up to logic 1 by pull-up resistors R0–R3. In the monitor 120, a monitor MID/MIX subcircuit 138 is added. The adapter MID/MIX subcircuit 136 and the monitor MID/MIX subcircuit 138 serve numerous functions: (1) they serve to simulate the hardwired MID subcircuit 32 of the prior art video subsystem 10, (2) they perform any handshaking needed to identify MIX-capable counterparts, and (3) they perform the dynamic communication between the video adapter 120 and the monitor 122.

Remaining monitor circuitry 146 differs from the circuitry of a prior art monitor 22 in several respects: (1) The remaining monitor circuitry 146 interfaces with and controls the monitor MID/MIX subcircuit 138 and must be designed to do so. (2) The remaining monitor circuitry 146 must be designed with any additional circuitry needed to provide the information to be sent to the adapter 120, such as vital product data and monitor characteristics. (3) Lastly, the remaining monitor circuitry 146 must be designed with any additional circuitry needed to implement any commands sent from the adapter 120, such as changing pixel resolution or changing signal frequency. In short, the nature and extent of the changes needed in the remaining monitor circuitry 146 depends entirely on the nature and the extent of the functions added to the monitor 122.

Likewise, remaining adapter circuitry 148 and remaining test subcircuitry 150 must be designed with any circuitry needed to perform any added functions. Like the remaining monitor circuitry 146, the nature and extent of the changes needed in the remaining adapter circuitry 148 and the remaining test subcircuitry depends entirely on the nature and the extent of the functions added to the adapter 120.

On power-up, the adapter 120 behaves as a prior art adapter 20. First, the adapter 120 will attempt to read, using either one or four reads as described above, the MID code from the four communications lines COMM0–COMM3 using the adapter MID/MIX subcircuit 136. The MID code the adapter 120 will read depends on what is attached to the display connector 128 of the adapter 120. If the adapter 120 is not connected to any monitor cable at all, the communication lines COMM0–COMM3 will remain pulled up to logic level 1 and the adapter 120 will read a MID code of $1111_2$ or $1111_s$. If the adapter 120 is connected to a prior art monitor 24 of a prior art monitor 22, the adapter 120 will read the MID code from the hardwired MID subcircuit 32 of the prior art monitor cable 24, whether the prior art monitor 22 is powered on or not. Again, the adapter reads the MID codes from the communication lines COMM0–COMM3 using the adapter MID/MIX subcircuit 136.

If the adapter 120 is connected to a monitor 122 of the present invention via a display cable 124 of the present invention, then the MID code the adapter 120 reads will depend on whether the monitor 122 is powered on or not. If the monitor 122 is not powered on, the communication lines COMM0–COMM3 will remain pulled up to logic level 1 by pull-up resistors R0–R3 and the adapter 120 will read a MID code of $1111_2$ or $1111_s$. If the monitor 122 is powered on then the monitor MID/MIX subcircuit 138 of the monitor 122 can present whatever MID code it desires on the communication lines COMM0–COMM3 for the adapter 120 to read. Once the adapter 120 reads the MID code, it makes the MID code available to the software.

Once the adapter 120 determines that a monitor is attached, the adaptor 120 must determine whether the connected monitor is MIX-capable or not. That is, the adapter 120 must determine if the unknown monitor attached is a monitor 122 of the present invention or a prior art monitor 22. Therefore, the adapter 120 sends a trigger signal to the unknown monitor that lets the unknown monitor know that the adapter 120 is MIX-capable. In the best mode contemplated by the inventor, this trigger signal consists of the adapter 120 placing both HSYNC and VSYNC in the same known logic state then toggling them both simultaneously from one state to the other at a predetermined rate (e.g., approximately 10 Khz) for a predetermined number of cycles (e.g., eight complete cycles). Although believed to not have the benefits of the above trigger signal, other trigger events are possible, such as a simple timer in either the monitor or the adapter.

A non-MIX monitor 20 will ignore the trigger signal. A MIX monitor 122 will respond to the trigger signal generated by the adapter 120 in such a manner that the adapter 120 knows the monitor 122 is indeed a MIX-capable monitor 122. In the best mode, the MIX monitor 122 will present a Powered on ID (PID) code along the communication lines COMM0–COMM3 to complete the handshake. The exact code is immaterial. The only requirement is that the PID be different from the code presented before handshaking, so the adapter 120 knows a MIX monitor 122 is present. Once the handshake is complete, the monitor MID/MIX subcircuit 138 ceases asserting the MID code along the communication lines COMM0–COMM3, allowing them to be pulled up to the open-collector floating state of $1111_2$ by the pull-up resistors R0–R3. The adapter 120 and monitor 122 are then free to begin communicating along the communication lines COMM0–COMM3 using the adapter MID/MIX subcircuit 136 and the monitor MID/MIX subcircuit 138, Numerous forms of communication between the adapter 120 and the monitor 122 are possible along communication lines COMM0–COMM3. It is immaterial which communication line or lines the two communicate over, as long as both the adapter 120 and the monitor 122 use the same line(s) for the same purposes. The $I^2C$ bus specifically contemplates bidirectional serial communication using two of the four lines, but numerous other communication schemes are possible. For example, the adapter 120 and monitor 122 could communicate along just one communication line: a single bidirectional data line, as shown in FIG. 3A. Alternatively, they could communicate using a clock line and a data line, thereby using two communication lines, as shown in FIG. 3B. In addition, they could use a clock line, a data line, and a framesync line, thereby using three communication lines, as shown in FIG. 3C. With four communication lines available, many parallel communications schemes are also possible. For example, the adapter 120 and monitor 122 could communicate using two data lines, a clock line, and a framesync line, as shown in FIG. 3D; or they could use three data lines and a single clock line, as shown in FIG. 3E. Unidirectional versions of the bidirectional communication schemes listed above are also possible. In the best mode, the communication is bidirectional using just two communication lines: a bidirectional clock line and a bidirectional data line, as shown in FIG. 3B.

In the bidirectional examples of the above paragraph, the adapter 120 and the monitor 122 share a common data line or lines. This invention also contemplates using unidirectional data lines. For example, the adapter 120 and the monitor 122 could communicate using a common clock line, generated by the adapter, a data line directed by the adapter 120 to the monitor 122, and a data line directed by the monitor 122 to the adapter 122, thereby using three communications lines. Numerous combinations and permutations of the above examples are possible and are intended to come within the scope of the invention.

If the monitor 122 is powered off when the adapter 120 transmits the trigger signal, either the adapter 120 will not assert the trigger signal or the monitor 122 will miss the trigger signal. Therefore, the monitor 122 must have some way of signalling to the adapter 120 that (1) it is now powered on, and, more importantly, (2) it is a MIX-capable monitor.

This can be accomplished in one of several ways. First, the adapter 120 can poll the communication lines COMM0–COMM3 for a code other than $1111_2$ or $1111_s$. Once a different code is read, the adapter 120 knows a monitor (type unknown) is now attached and the adapter 120 may then initiate handshaking, as described above.

In the alternative, this can be accomplished by having the monitor 122 present a Powered on ID (PID) when it turns on. The adapter 120 would periodically poll the communications lines COMM0–COMM3 for the PID code. Once the adapter 120 receives the appropriate PID code, it would present the trigger signal. The monitor 122 would respond to the trigger signal with an appropriate MID code, thereby completing the handshaking.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. For example, the entire computer system and, therefore, the video subsystem 110, could conceivably be designed inside a single enclosure, thereby removing the need for external connectors 126 and 128 or an external display cable 124. These would then be replaced by appropriate internal electrical connection and conduction means. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. A video subsystem of a computer system comprising:

a video adapter device;

a video monitor device; and a display cable electrically connecting said video monitor to said video adapter; said display cable including at least one monitor identification line;

said video monitor having means to generate selected, fixed monitor identification information on said at least one monitor identification line;

said video adapter having means to receive said monitor identification information via said at least one monitor identification line;

said video adapter and said video monitor having means for generating a communications link for dynamic communications between said video adapter and said video monitor via said at least one monitor identification line;

said video monitor generating said fixed monitor identification information on said at least one monitor identification line before a triggering event; and after said triggering event, said video monitor ceasing generating said monitor identification information on said at least one monitor identification line and said video adapter and said video monitor generating said communications link along said at least one monitor identification line.

2. The video subsystem of claim 1 wherein said display cable comprises a 15-pin display cable.

3. The video subsystem as defined in claim 1 wherein said video adapter has means to generate said triggering event.

4. The video subsystem as defined in claim 1 wherein said communications link generated by said generating means is configured as a bidirectional serial link to allow bidirectional communication between said video adapter and said video monitor via said at least one monitor identification line.

5. The video subsystem as defined in claim 1 wherein said communications link generated by said generating means is configured as a bidirectional serial link and said generation means includes means to generate a clock signal and a data signal.

6. The video subsystem as defined in claim 1 wherein said video adapter has means to generate said triggering event; and wherein said communications link generated by said generating means is configured as a bidirectional serial link to allow bidirectional communication between said video adapter and said video monitor via said at least one monitor identification line.

7. A video subsystem as defined in claim 1 wherein said video adapter is configured to dynamically transmit display parameters to said video monitor via said at least one monitor identification line.

8. A video subsystem as defined in claim 1 wherein said video monitor is configured to actively and dynamically transmit monitor characteristics to said video adapter via said at least one monitor identification line.

9. A video subsystem of a computer system comprising:

(a) a video adapter having:

a video signal generator for generating at least one video signal corresponding to an optical image on at least one video line and for generating at least one video synchronization signal on at least one video synchronization lines, monitor identification reading circuitry for reading monitor identification information from at least one monitor identification line, and adapter communications circuitry for selectively communicating using at least one binary communications signal via said at least one monitor identification line; and (b) a video monitor having:

video image display circuitry in circuit communication with said video signal generator via said at least one video line and said at least one video synchronization line for receiving the at least one video signal and the at least one synchronization signal and for displaying the optical image corresponding to the video signal, active monitor identification generation circuitry in circuit communication with said monitor identification reading circuitry via said at least one monitor identification line for selectively generating monitor identification information along said at least one monitor identification line, and monitor communications circuitry in circuit communication with said adapter communications circuitry via said at least one monitor identification line for selectively communicating with said adapter communications circuitry using the at least one binary communications signal via said at least one monitor identification line;

(1) wherein said video adapter and video monitor are configured such that:

said monitor identification generation circuitry generates monitor identification information along said at least one monitor identification line, said monitor identification reading circuitry reads the monitor identification information along said at least one monitor identification line, and, responsive to a trigger event, said monitor identification generation circuitry ceases generating monitor identification information along said at least one monitor identification line and thereafter said adapter communications circuitry and said monitor communications circuitry communicate using the at least one binary communications signal via said at least one monitor identification line; and (2) wherein said video adapter and video monitor are further configured such that concurrently:

said video signal generator of said video adapter generates the at least one video signal along said at least one video line to said video image display circuitry of said video monitor, said video signal generator of said video adapter generates the at least one video synchronization signal on at least one video synchronization line to said video image display circuitry of said video monitor, said video image display circuitry of said video monitor receives the at least one video signal and the at least one synchronization signal from said video signal generator, said video image display circuitry of said video monitor displays the optical image corresponding to the at least one video signal, and said adapter communications circuitry and said monitor communications circuitry communicate using the at least one binary communications signal via said at least one monitor identification line.

10. A video subsystem as defined in claim 9 wherein said adapter communications circuitry of said video adapter is configured to dynamically transmit display parameters to said monitor communications circuitry of said video monitor via said at least one monitor identification line.

11. A video subsystem as defined in claim 9 wherein said monitor communications circuitry of said video monitor is configured to dynamically transmit monitor characteristics to said adapter communications circuitry of said video adapter via said at least one monitor identification line.

12. A video subsystem as defined in claim 9 wherein said video subsystem comprises at lease two monitor identification lines and said at least one binary communications signal comprises a binary clock signal and a unidirectional binary serial data signals, both of which are generated by said adapter communications circuitry and asserted onto said at least two monitor identification lines.

13. A video subsystem as defined in claim 9 wherein one of said at least one monitor identification lines is reused for bidirectional binary communications between said video adapter and said video monitor and said binary communications signal comprises:

(a) an adapter binary serial data signal that is generated by said adapter communications circuitry, asserted onto said one monitor identification line, and received by said monitor communications circuitry, and (b) a monitor binary serial data signal that is generated by said monitor communications circuitry, asserted onto said one monitor identification line, and received by said adapter communications circuitry.

14. A method of interfacing between a video adapter and a video monitor comprising the steps of:

(a) generating on at least one video line with the video adapter at least one video signal having an optical image associated therewith;

(b) receiving from the at least one video line with the video monitor the at least one video signal;

(c) displaying with the monitor the optical image associated with the at least one video signal;

(d) actively generating with the monitor along at least one monitor identification line monitor identification information;

(e) receiving from the at least one monitor identification line with the adapter the generated monitor identification information;

(f) ceasing generation of the monitor identification information;

(g) after said step of ceasing generation of the monitor identification information and concurrently with said step of generating the at least one video signal, reusing said at least one monitor identification line by dynamically transmitting binary communications between the adapter and the monitor via said at least one monitor identification line.

15. A video adapter comprising:

(a) a video signal generator for generating at least one video signal corresponding to an optical image on at least one video line and for generating at least one video synchronization signal on at least one video synchronization line, (b) monitor identification reading circuitry for reading monitor identification information from at least one monitor identification line, and (c) adapter communications circuitry for selectively communicating using at least one binary communications signal via said at least one monitor identification line; and (1) wherein said video adapter is configured such that:

said monitor identification reading circuitry reads the monitor identification information from said at least one monitor identification line, and, responsive to a trigger event, said adapter communications circuitry communicates using the at least one binary communications signal via said at least one monitor identification line; and (2) wherein said video adapter is further configured such that concurrently:

said video signal generator of said video adapter generates the at least one video signal along said at least one video line, said video signal generator of said video adapter generates the at least one video synchronization signal on at least one video synchronization line, and said adapter communications circuitry communicates using the at least one binary communications signal via said at least one monitor identification line.

16. A video monitor comprising:

(a) video image display circuitry for receiving at least one video signal corresponding to an optical image via at least one video line and at least one synchronization signal via at least one video synchronization line and for displaying the optical image corresponding to the video signal, (b) active monitor identification generation circuitry for selectively generating monitor identification information along at least one monitor identification line, and (c) monitor communications circuitry for selectively communicating using at least one binary communications signal via said at least one monitor identification line;

(1) wherein said video monitor is configured such that:

said monitor identification generation circuitry generates monitor identification information along said at least one monitor identification line, responsive to a trigger event, said monitor identification generation circuitry ceases generating monitor identification information along said at least one monitor identification line and thereafter said monitor communications circuitry communicates using the at least one binary communications signal via said at least one monitor identification line; and (2) wherein said video monitor is further configured such that concurrently:

said video image display circuitry of said video monitor receives the at least one video signal and the at least one synchronization signal, said video image display circuitry of said video monitor displays the optical image corresponding to the at least one video signal, and said monitor communications circuitry communicates using the at least one binary communications signal via said at least one monitor identification line.

* * * * *